United States Patent [19]

Takeuchi

[11] 3,966,393

[45] June 29, 1976

[54] HOT BLAST STOVE APPARATUS

[76] Inventor: Kikuo Takeuchi, 18-17, 1-chome, Takaban-cho, Meguro, Tokyo, Japan

[22] Filed: Apr. 28, 1975

[21] Appl. No.: 572,446

[30] Foreign Application Priority Data

Dec. 23, 1974 Japan ..... 49-146716

[52] U.S. Cl. ..... 432/40; 432/214; 432/219; 432/216; 165/9.2; 266/139

[51] Int. Cl.[2] ..... C21B 9/10; F23L 15/02

[58] Field of Search ..... 165/9.1–9.4; 266/14; 432/219–223, 31, 40, 90, 215, 201, 214

[56] References Cited

UNITED STATES PATENTS

| | | | |
|---|---|---|---|
| 239,325 | 3/1881 | Gordon | 432/40 |
| 1,588,203 | 6/1926 | Stein | 165/93 |
| 1,848,242 | 3/1932 | Classen | 165/9.2 |
| 1,941,446 | 12/1933 | Isley | 432/40 |
| 2,493,458 | 1/1950 | Koenig | 165/9.4 |
| 2,505,861 | 5/1950 | Johnson | 432/216 |
| 2,514,084 | 7/1950 | Mowat | 432/219 |
| 3,178,160 | 4/1965 | Walther et al. | 432/40 |
| 3,220,458 | 11/1965 | Middleton | 432/219 |
| 3,284,070 | 11/1966 | Nishida et al. | 432/40 |

FOREIGN PATENTS OR APPLICATIONS

| | | | |
|---|---|---|---|
| 730,407 | 5/1932 | France | 432/219 |
| 615,621 | 1/1949 | United Kingdom | 432/219 |

*Primary Examiner*—John J. Camby
*Assistant Examiner*—Henry C. Yuen
*Attorney, Agent, or Firm*—Haseltine, Lake & Waters

[57] ABSTRACT

A hot blast stove apparatus comprising a hot blast stove having a discharge passage for hot blast gases, and a temperature equalizer material in the passage such that the hot blast gases discharged from the hot blast stove, gradually lowering in temperature with lapse of time, are continuously supplied with heat from the equalizer material and the hot blast gases discharged from the passage are at an equalized temperature.

4 Claims, 10 Drawing Figures

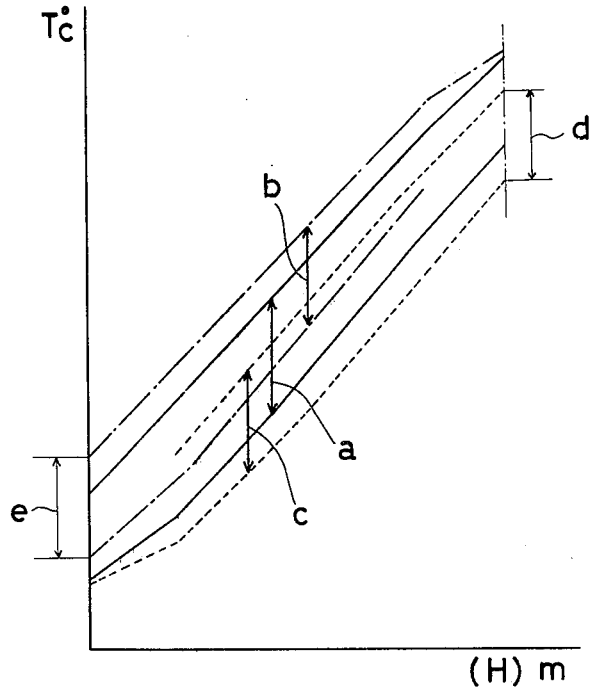
Fig. 3
Fig.4
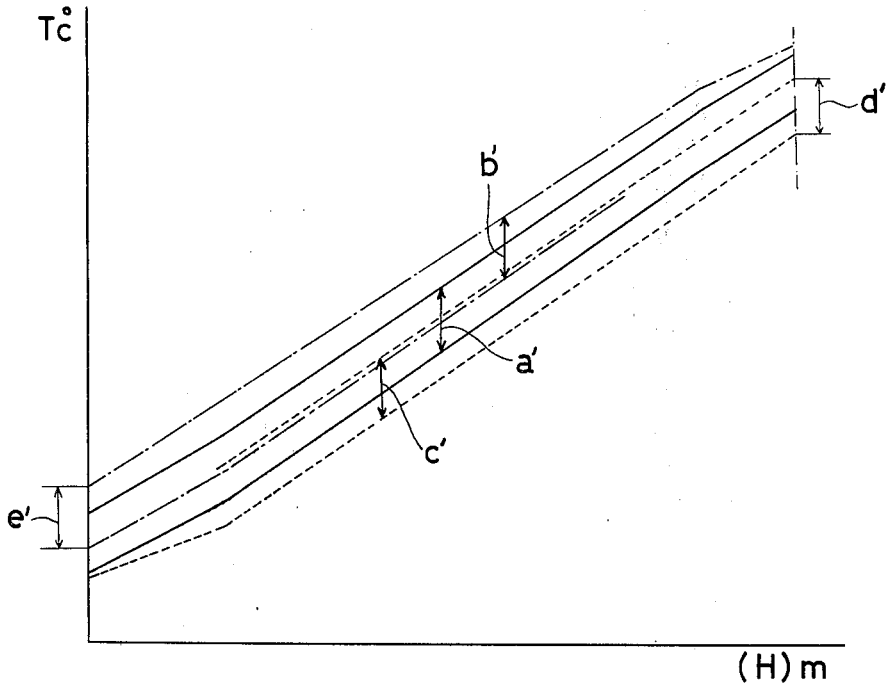

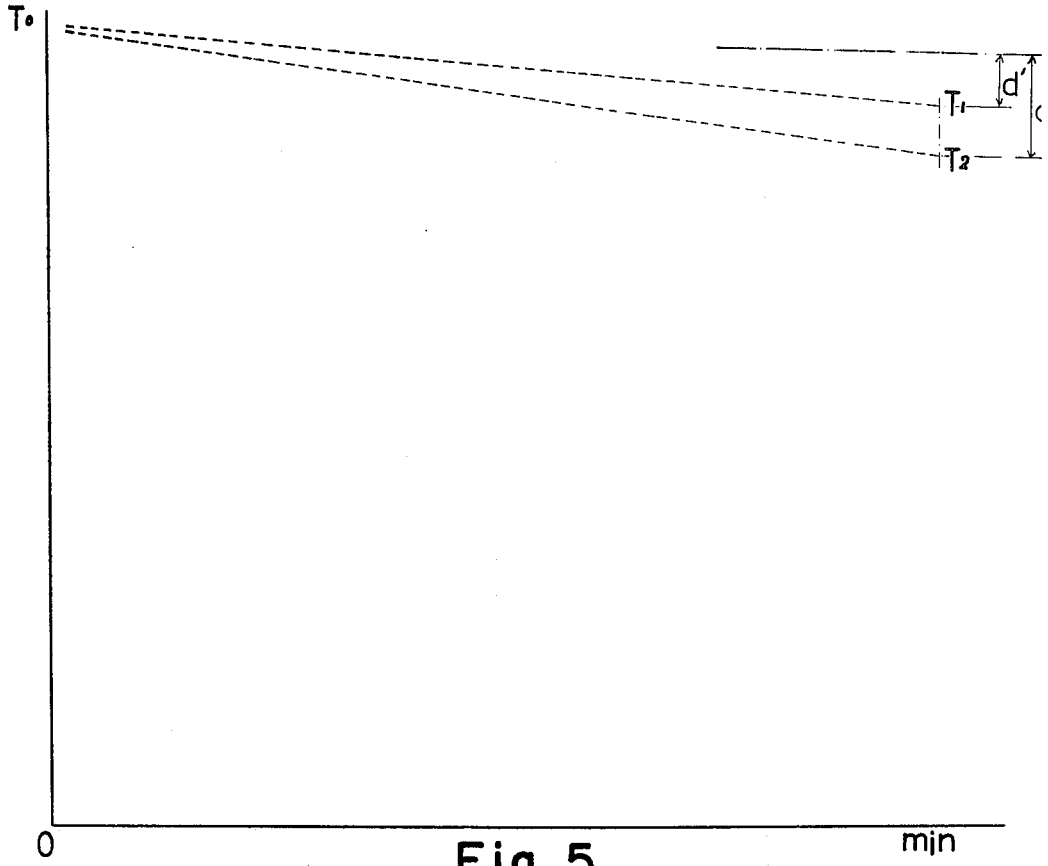
Fig. 5
Fig. 6
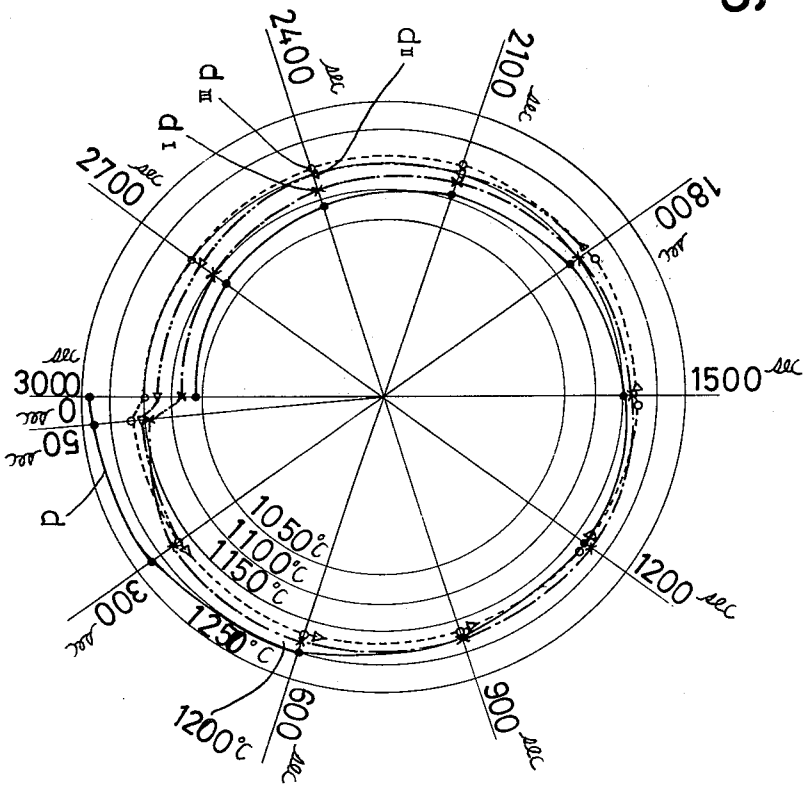

HOT BLAST STOVE APPARATUS

FIELD OF THE INVENTION

This invention relates to a hot blast stove apparatus in which a hot blast discharged from a hot blast stove can be continuously supplied to a blast furnace while being equalized in temperature, while the amount of regenerative material within the hot blast stove can be substantially reduced compared to a conventional stove.

BACKGROUND

It has been usual in conventional apparatus of this kind for continuously supplying a hot blast at a required temperature, to supply a hot blast at a temperature higher than the required temperature and to mix this hot blast with cooling air to equalize its temperature.

This conventional arrangement, however, is deficient in that a regenerative layer within the stove must be comparatively great in height so that the minimum temperature of the hot blast obtained at the end of the blast supply period of time is above the required temperature. Additionally, a control means is required for adjusting the supply of blast gas and cooling air to maintain the required temperature.

SUMMARY OF THE INVENTION

An object of this invention is to provide a hot blast stove apparatus in which the deficiencies mentioned above are eliminated while almost the same capability thereof is maintained even when the amount of the regenerative layer within the stove is decreased to about one-half of that in the conventional stove. The invention is characterized in that in a hot blast discharging passage of the hot blast stove there is incorporated a temperature equalizer means so that the hot blast discharge from the hot blast stove, gradually lowering in temperature with lapse of time, may be continuously supplied to a blast furnace or the like while being equalized in temperature by the action of the temperature equalizing means.

BRIEF DESCRIPTION OF DRAWING

FIG. 3 is a graph showing temperature changes at respective height positions of the regenerative layer within the stove of FIG. 1, FIG. 4 is a similar graph for a conventional stove, FIG. 5 is a graph showing hot blast temperature changes with lapse of time according to the stove of the invention and a conventional stove, FIG. 6 is a circular graph showing change in hot blast temperature with lapse of time within a temperature equalizer.

DETAILED DESCRIPTION

Figure 1:
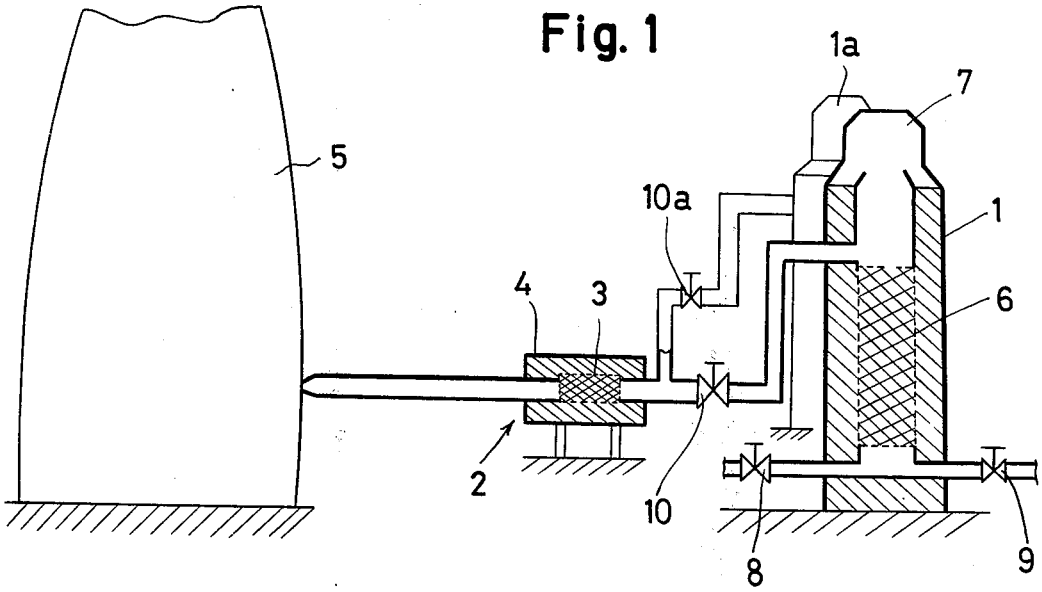
FIG. 1 is a diagrammatic illustration of one embodiment according to this invention.
Figure 2:
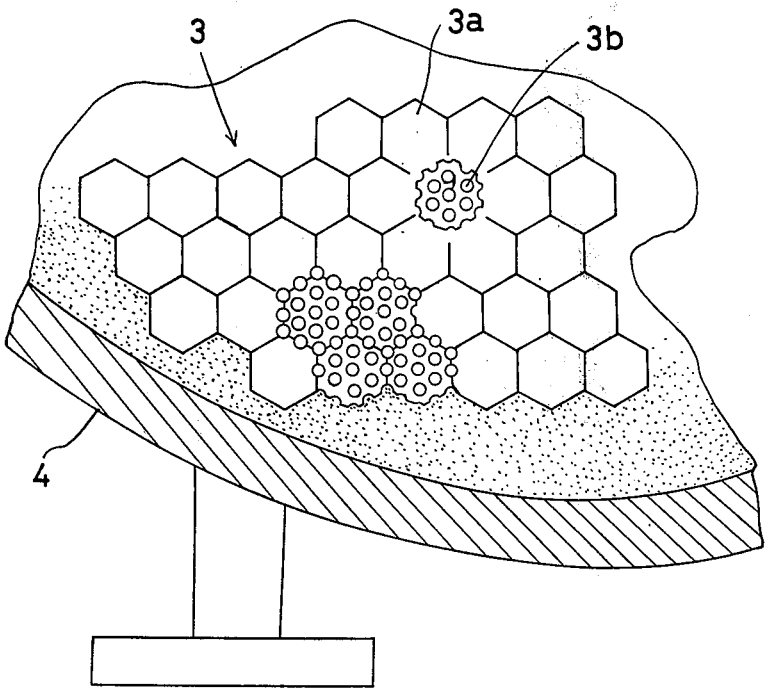
FIG. 2 is an enlarged sectional view of a portion of FIG. 1.

FIG. 1 shows two cylindrical hot blast stoves 1, 1*a*. Each of these stoves has a regenerative layer 30 meters in height, which is nearly one-half of that in a conventional stove. Each stove is 8 meters in diameter. The stoves 1, 1*a* are connected via respective hot blast valves 10, 10*a* to a single common hot blast discharge passage 2 connected to a blast furnace 5. The discharge passage 2 is provided with a temperature equalizer 4 filled with a regenerative member 3 constituting a regenerative layer 4 meters in diameter and 15 meters in length. The temperature equalizer 4 is composed of a comparatively large diameter tubular container filled with the regenerative member 3, and the same is placed horizontally in alignment in passage 2. The regenerative member 3, as shown in FIG. 2, is constituted as a hexagonal column formed from checker brick 3*a* having a number of through holes 3*b*, each being 38 mm in diameter, and a number of such bricks are juxtaposed one upon another in such a manner that the through holes 3*b* are in coincidence in the axial direction of the equalizer 4. Numeral 6 denotes a regenerative layer within the hot blast stove 1, numeral 7 denotes a combustion heating means, numeral 8 denotes a combustion gas exhaust valve and numeral 9 denotes an air supply valve.

The stoves 1, 1*a* are each constructed such that, when the blast supply amount is 6000 $Nm^3$/min. and the blast supply time is 3000 sec., the change of temperature of the hot blast gases with the passage of time from 0 sec. to 3000 sec. is 180°C. In this case, the temperature change *a* of the regenerative member 6, the temperature change *b* of the heating gas, the temperature change *c* of the supply air, the temperature change *d* of the hot blast and the temperature change *e* of the exhaust gas are as shown in FIG. 3, each for passage of time from 0 sec. to 3000 sec., at respective height positions of the regenerative member 6. Namely, the temperature of the regenerative member 6 is lowered by *b*, the temperature of the supply air is lowered by *c*, the temperature of the hot blast is lowered by *d* and the temperature of the exhaust gas is lowered by *e* at every height position of the regenerative layer 6 with passage of time of from 0 sec. to 3000 sec.

In the conventional type of hot blast stove, that is, a stove having a regenerative layer of 50 meters in height and 8 meters in diameter, corresponding temperature changes under the same operating conditions, that is, the regenerative member temperature change *a'*, the heating gas temperature change *b'*, the supply air temperature change *c'*, the hot blast temperature change *d'*, and the exhaust gas temperature change *e'* at respective height positions of the regenerative layer with passage of time are as shown in FIG. 4. If these two Figures are compared with one another, it will be noted that the regenerative layer height and each of the foregoing various temperature changes are in inverse proportional relationship. Namely, the greater the regenerative layer height, the lower the degree of temperature change.

The hot blast temperature change *d*, *d'* with passage of time are also shown in FIG. 5. It will be also clear therefrom that the hot blast temperature change with passage of time is in inverse proportional relationship with the height of the regenerative layer.

The hot blast which is discharged from the stove 1 or 1*a* is lowered in temperature from 1240°C to 1060°C in the interval of 3000 sec. (as shown by a temperature curve *d* in FIG. 5) and when this hot blast is applied to the temperature equalizer 4, the change of the temperature thereof with lapse of time at the 1/7, 4/7 and 7/7 positions, respectively, from the inlet of the equalizer 4 is as shown by curves *d*I, *d*II, *d*III in FIG. 6. It will be seen therefrom that the hot blast temperature change with lapse of time at the outlet of the equalizer 4 is within a range from 1170°C to 1150°C as shown by the curve *d*III.

The temperature equalizer 4 serves in such a manner that, when the hot blast is above the required temperature $T_1$, the thermal energy of the hot blast is stored in the regenerative member 3 within the equalizer 4 and when the hot blast is gradually lowered in temperature to $T_2$, below the required temperature $T_1$, the thermal energy previously stored in the regenerative member 3 is added to the hot blast, whereby the hot blast can be always kept nearly at the required temperature $T_1$ at the outlet of the equalizer 4 for being supplied continuously to the blast furnace 5.

Then, the temperature equalizer 4 is supplied from the hot blast stove 1*a* with a hot blast, whose temperature $T_0$ is above the required temperature $T_1$ at the beginning of hot blast supply, and it operates in almost the same manner as above, and thus a hot blast of nearly the required temperature $T_1$ is supplied continuously to the blast furnace 5.

Accordingly, if a comparison is made between the temperature change with lapse of time in the conventional apparatus and that in the present invention, the following will be noted:

In the conventional arrangement, as shown in FIG. 7(a), for maintaining the required temperature $T_1$, cooling air is supplied for mixing during the period of $t_0 - t_1$ such that the temperature $T_0$ of the hot blast at the beginning of blast supply is lowered to the temperature $T_1$, and a fresh hot blast of the temperature $T_0$ is then supplied from another hot blast stove when the temperature is lowered to $T_1$, and thus the hot blast supply from hot blast stoves is changed over with a cycle of $t_0 - t_1$.

Figure 7:
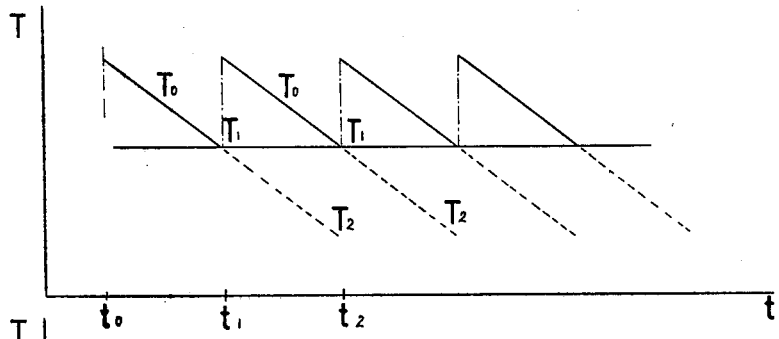
FIGS. 7a-7d are graphs showing the comparison between the hot blast temperature at the outlet of the equalizer according to the invention and that at the outlet of the conventional stove.
Figure 7:
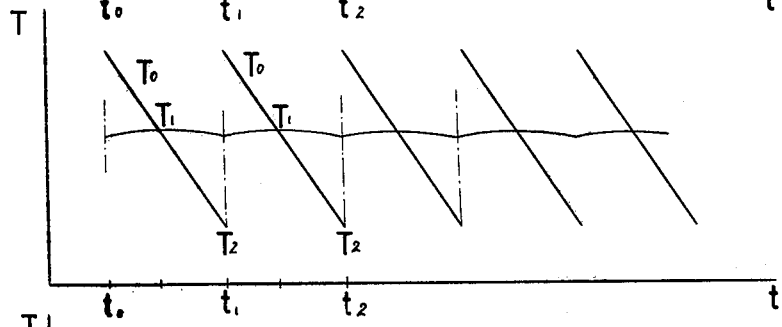
Figure 7:
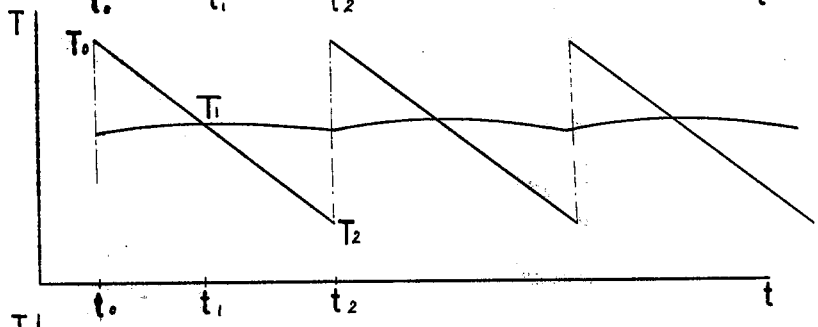
Figure 7:
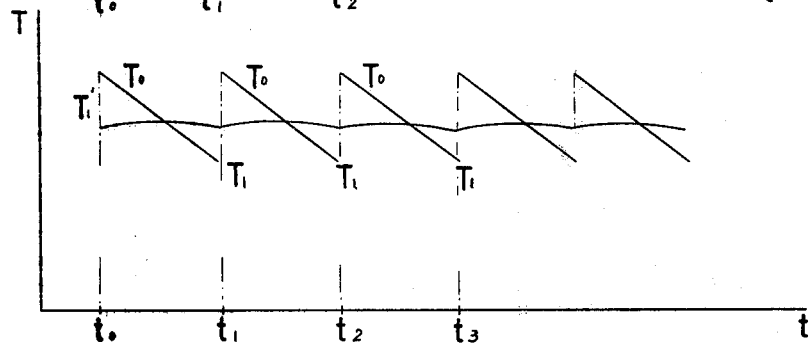

In the embodiment of this invention, however, the amount of the regenerative layer 6 in each of the stoves 1, 1 *a* is decreased to about one-half of that in the conventional stove, so that the temperature change of the hot blast with lapse of time is lowered from a temperature $T_0$ to a temperature $T_2$ within the time period of $t_0 - t_1$, that is, 2 times that in the foregoing conventional case, as shown in FIG. 7(*b*). However, in this case, it is equalized in temperature by the action of the regenerative material 3 within the equalizer 4, so that a temperature of about ½ $(T_0 + T_2)$, that is, nearly the required temperature $T_1$ can be maintained during the cycle of $t_0 - t_1$. Accordingly, the embodiment of this invention can provide almost the same effect as in the conventional case while using one-half the regenerative layer 6 of the conventional case.

Similarly, in an embodiment of this invention where the height of the regenerative layer of each stove 1, 1*a* is equal to that in the conventional stove, as shown in FIG. 7(*c*), if the required temperature is assumed to be $T_1$, the required temperature $T_1$ can be maintained for a period of $t_0 - t_2$, and thus the hot blast supply period of time can be prolonged. Additionally, if the hot blast supply period of time is made equal to that in the conventional case, as shown in FIG. 7(*d*), the hot blast temperature is increased by ½ $(T_0 - T_1)$ and thus the hot blast supply can be effected while keeping a temperature of $T_1'$.

As for the regenerative member for the temperature equalizer 4, both the inlet and outlet of the equalizer 4 reach temperatures above 1000°C, so that a metallic grating cannot be used. Accordingly, instead thereof, columnor checker bricks which can be put on one another in layers are preferably used. Especially when a square or hexagonal column form of checker bricks are used, so to be placed horizontally, with every brick, two upper side surfaces thereof serve to receive a load from above and two lower side surfaces thereof are inserted between the lower bricks as a wedge, so that the layer of the piled checker bricks can be constructed to be extremely resistant to the hot air blast aerodynamic loads or earthquake loads.

Thus, according to this invention, even if the regenerative layer within the stove is decreased to one-half of that in the conventional stove, the hot blast temperature reduction with lapse of time can be equalized and thereby a hot blast of the required temperature can be continuously supplied. Accordingly the regenerative material, the material for construction of the hot blast stove and the material for the base member of the stove can be substantially reduced and this is very economical. Additionally, the load applied to the regenerative layer can be reduced to one-half of the conventional layer, so that a limitation of selection of the material of the regenerative member limited by a creep phenomenon under a high temperature load can be relaxed, and additionally a blast amount control operation for maintaining the hot blast to be of a required temperature can be eliminated.

What is claimed is:

1. A hot blast stove apparatus comprising a regenerative hot blast stove, combustion heating means in said stove, heat regenerative material in said stove for being heated by said heating means, said stove having an outlet for discharge of hot blast gases from the stove, a main hot blast gas duct externally connected to said outlet for conveying hot blast gases from said stove, valve means for cyclical discharge of hot blast gases from said stove to said duct and temperature equalizer means in said main duct for absorbing heat from the hot blast gases at the beginning of a discharge cycle of the hot blast gases from the stove to store the heat and for releasing the stored heat to the hot blast gases at the end of the discharge cycle such that the hot blast gases are delivered from said duct at an equalized temperature during said cycle, said temperature equalizer means comprising a tubular container coupled to said duct, and a mass of heat regenerative material including juxtaposed checker brick with through holes therein filling said tubular container and through which the blast gases pass.

2. A hot blast stove apparatus as claimed in claim 1 wherein said temperature equalizer means is disposed downstream of said valve means.

3. A hot blast stove apparatus as claimed in claim 1 wherein two of said stoves are provided, each connected to said main discharge duct and including said valve means respectively for selectively connecting each stove to said passage.

4. A hot blast stove apparatus as claimed in claim 1 wherein said main duct is horizontally disposed at the location where the temperature equalizer means is placed.

* * * * *